United States Patent [19]

Miyazawa et al.

[11] Patent Number: 4,572,681

[45] Date of Patent: Feb. 25, 1986

[54] WIRE DOT PRINT HEAD

[75] Inventors: Yoshinori Miyazawa; Shigeki Mizuno, both of Shiojiri, Japan

[73] Assignee: Epson Corporation, Tokyo, Japan

[21] Appl. No.: 550,275

[22] Filed: Nov. 9, 1983

[30] Foreign Application Priority Data

| | | | |
|---|---|---|---|
| Nov. 12, 1982 | [JP] | Japan | 57-199437 |
| Nov. 12, 1982 | [JP] | Japan | 57-199440 |
| Nov. 15, 1982 | [JP] | Japan | 57-172599[U] |
| Nov. 22, 1982 | [JP] | Japan | 57-205170 |
| Nov. 22, 1982 | [JP] | Japan | 57-205172 |
| Feb. 15, 1983 | [JP] | Japan | 58-23059 |

[51] Int. Cl.[4] ..... B41J 3/12

[52] U.S. Cl. ..... 400/124; 101/93.05

[58] Field of Search ..... 400/124; 101/93.05; 335/274, 276

[56] References Cited

U.S. PATENT DOCUMENTS

| | | | |
|---|---|---|---|
| 3,904,011 | 9/1975 | Matschke et al. | 400/124 |
| 3,991,869 | 11/1976 | Berrey | 400/124 |
| 4,185,929 | 1/1980 | Hebert | 400/124 |
| 4,248,540 | 2/1981 | Bellinger | 400/124 |
| 4,368,353 | 1/1983 | Ando et al. | 400/124 X |
| 4,389,127 | 6/1983 | Bellinger | 400/124 |
| 4,394,093 | 7/1983 | Asano et al. | 400/124 |
| 4,407,591 | 10/1983 | Adamoli et al. | 400/719 X |
| 4,447,166 | 5/1984 | Ochiai et al. | 400/124 |

FOREIGN PATENT DOCUMENTS

| | | | |
|---|---|---|---|
| 27365 | 3/1981 | Japan | 400/124 |
| 20467 | 2/1983 | Japan | 400/124 |

*Primary Examiner*—Paul T. Sewell

*Attorney, Agent, or Firm*—Blum, Kaplan, Friedman, Silberman & Beran

[57] ABSTRACT

The printing head for a wire-type dot printer includes a plurality of electromagnetic coils, a wire, a permanent magnet, and a leaf spring. The arrangement of the wire and the leaf spring allows the print head to operate stably during high-speed operation. The wire dot print head has a head body in which the wire drive units are assembled so there is no problem with magnetic interference between the electromagnets. In addition, the wire dot print head may be comprised of a multiplicity of wires, and may be of a double-deck construction type which renders the unit more compact. This arrangement allows the construction of a multiwire high speed print head which can be easily assembled from simple parts.

12 Claims, 17 Drawing Figures

WIRE DOT PRINT HEAD

BACKGROUND OF THE INVENTION

The present invention relates to a wire dot print head, and more particularly, to a spring-charged head employing a permanent magnet for shortening the head response time and reducing electric power consumption allowing for high speed printer operation.

U.S. Pat. No. 4,348,120 discloses a spring-charged printer head having a plurality of wire drivers, each driver composed of a permanent magnet, wires, electromagnets and other components. The wire drivers are arranged in a circular pattern. The permanent magnet is ring-shaped and shared by the wire drivers. The wires are fixed to a leaf spring at an angle of about 90°. Using this construction, the head has an increased outside diameter, the head components are complex in shape, and the head cannot be easily assembled.

In addition, since the magnetic circuits for the wires are not separated from each other, there are magnetic interferences between the electromagnets. This causes the wire speeds to vary from each other depending on the numbers of coils being energized. This results in varying printing densities, and sometimes in total printing failures. One solution is to change the coil driving conditions for each printing pattern to yield equal wire speeds. This arrangement, however, requires an expensive apparatus.

There are also limitations on the high-speed operation of the head due to the large inertia of the movable component as well as the increased power consumption and excessive heating of the head. Leaf springs serving as a driving source of the wires are subject to secondary vibrations, thereby causing the wires to move unstably. This has posed a limitation on operation at higher speeds. To cope with this in the conventional art, crossed springs have been employed as wire drive springs. However, these springs are complex in construction, the head cannot be assembled easily, and the cost of the head is increased.

SUMMARY OF THE INVENTION

According to the present invention, each wire drive unit includes a wire and a permanent magnet, a coil, a leaf spring and other components independently provided for each wire, with the wire and leaf spring extending substantially parallel to each other. The wire dot print head has a head body in which the wire drive units are assembled. There is no problem with magnetic interference between the electromagnets in the arrangement in accordance with the invention, and the wires can be operated stably at high speed. In addition, the wire dot print head may include a multiplicity of wires, and it may be of a double-deck construction type which renders the unit more compact. This arrangement allows the construction of a multiwire high speed print head which can be assembled easily from simple parts.

Accordingly it is an object of this invention to provide a spring charged print head incorporating a permanent magnet for each of a plurality of moving wires to move said wires stably at high speeds.

Another object of the invention is to provide a print head having electromagnets free from magnetic interference between them.

A further object of the invention is to provide a highly responsive print head with a simplified construction.

Still another object of the invention is to provide a print head which can be easily assembled.

Still objects and advantages of the invention will in part be obvious and will in part be apparent from the specifications and drawings.

The invention accordingly comprises the features of constructions, combinations of elements, and arrangements of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which.

DETAILED DESCRIPTION OF THE PREFERRED EMBODIMENTS

Figure 1:
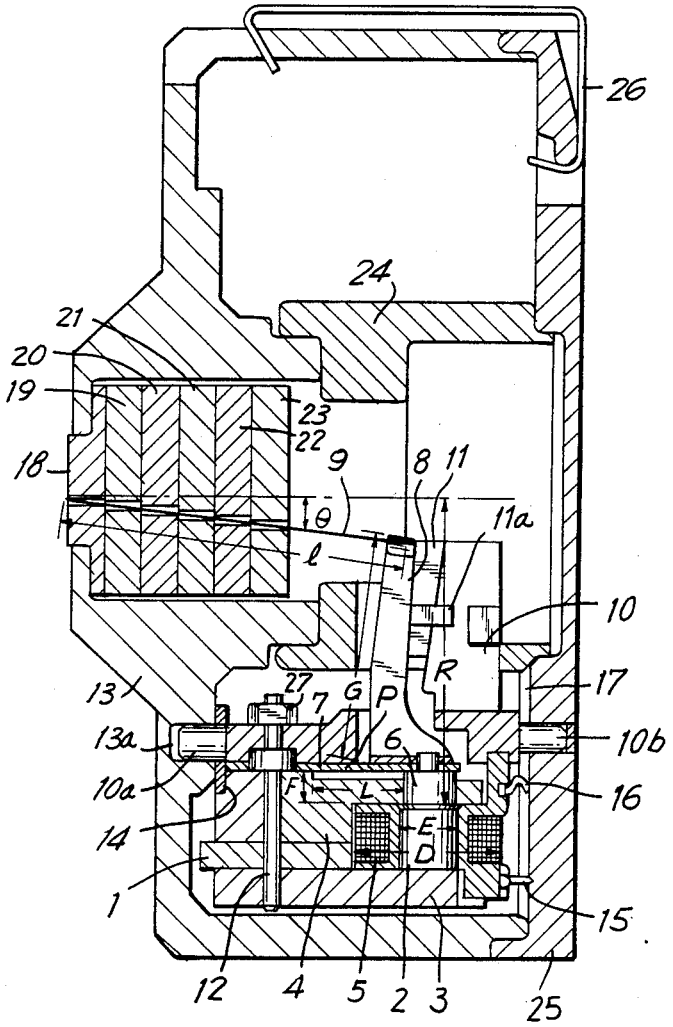
FIG. 1 is a cross-sectional view of a wire dot printer head according to an embodiment of the present invention.
Figure 2:
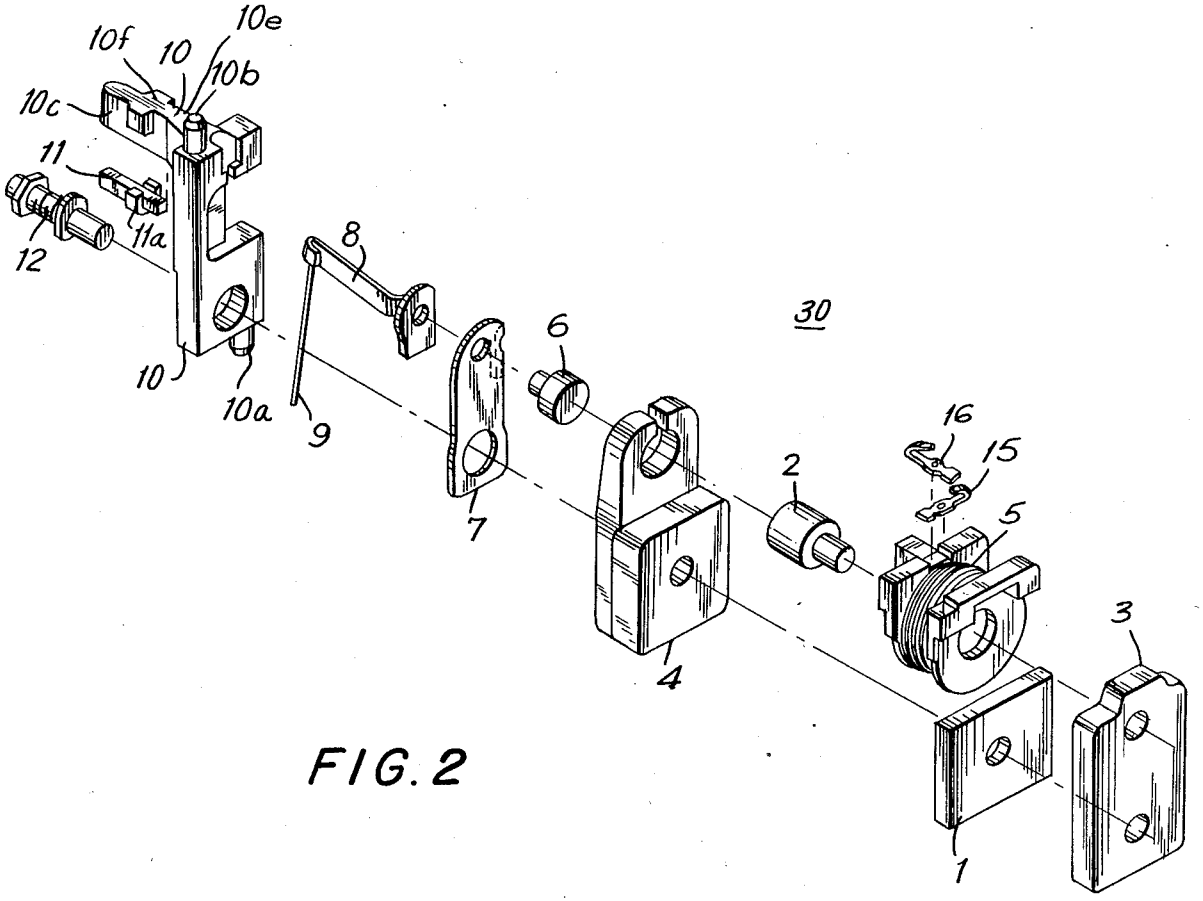
FIG. 2 is an exploded perspective view of a wire drive unit in the wire dot print head as shown in FIG. 1.

FIG. 1 is a cross-sectional view of a single-deck, 12-pin wire dot printing head incorporating a wire drive print mechanism according to the present invention. FIG. 2 is an exploded perspective view of a wire drive unit in the wire dot print head of the present invention.

Figure 4A:
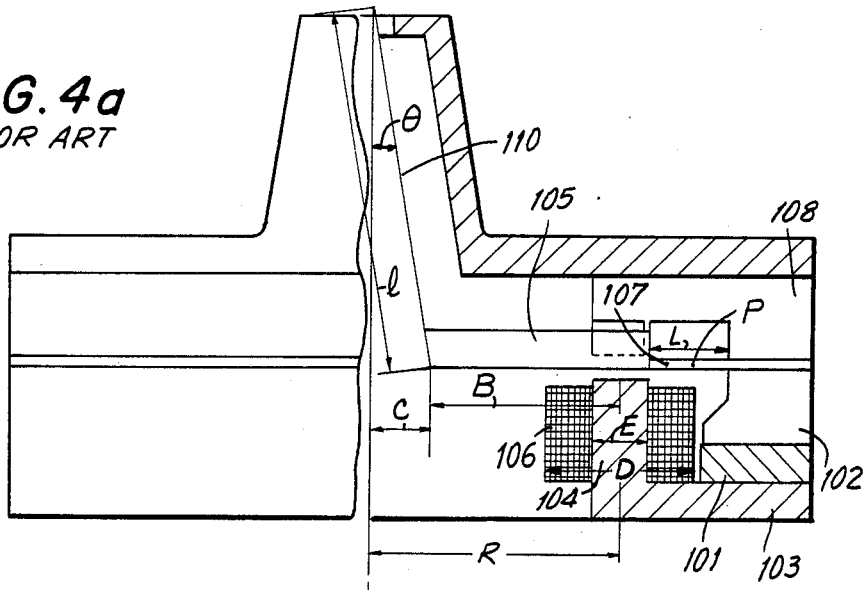
FIG. 4a PRIOR ART
FIG. 4*a* is a partially cross-sectional view of a conventional wire dot print head.
Figure 4B:
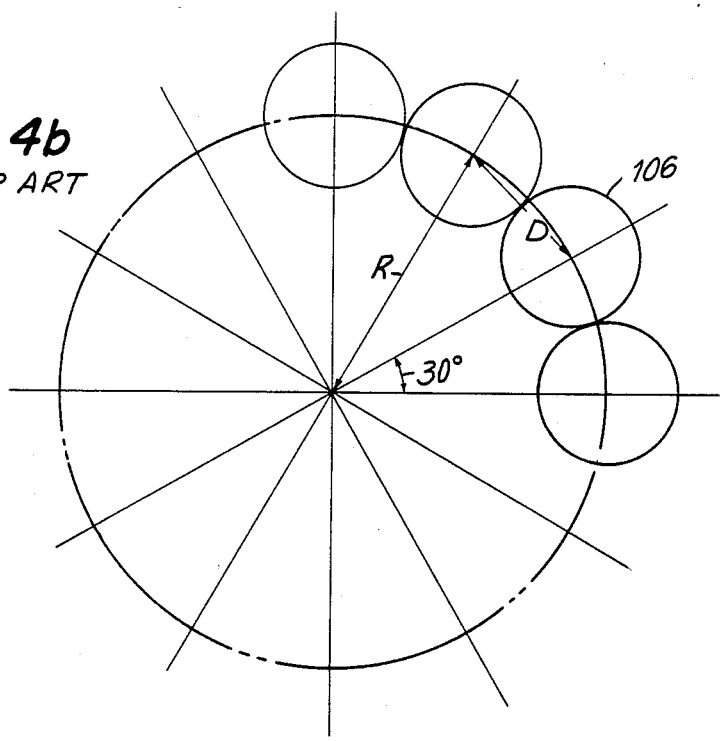
FIG. 4b PRIOR ART
FIG. 4*b* is a diagram showing the arrangement of coils in a conventional wire dot print head.
Figure 5A:
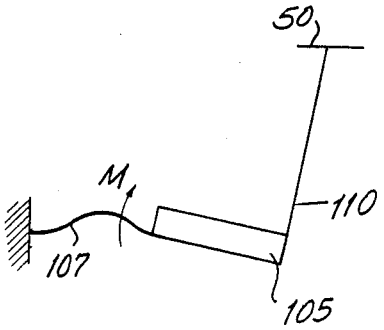
FIG. 5a PRIOR ART
FIG. 5*a* is a schematic diagram of a leaf spring in a conventional wire dot print head.
Figure 5B:
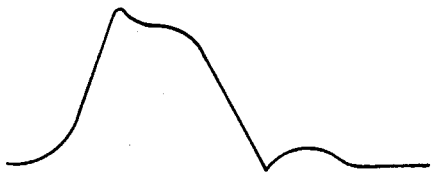
FIG. 5b PRIOR ART
FIG. 5*b* is a diagram showing the time dependent displacement relationship of a wire in a conventional wire dot print head.

Referring first to FIG. 4, which shows a conventional print head, a magnetic circuit is formed by a permanent magnet 101, a core 104, an upper yoke 108, a lower yoke 103, and a spacer 102 which together form a magnetic circuit. An armature 105 is disposed in the magnetic circuit and can be attracted by the core 104 under a magnetic flux generated by the permanent magnet 101 thereby deforming a leaf spring 107. When a current is passed through a coil 106, which is wound on the core 104, for a certain period of time to enable the coil 106 to produce a magnetic force in a direction for canceling out the magnetic flux from the permanent magnetic 101, the armature 105 is released from the core 104, releasing the force of the leaf spring 107 to project a wire 110, fixed to the distal end of the armature 105, until the end of wire 110 hits a sheet of print paper (not shown). When the current is removed, the armature 105 is again attracted to the core 104 and the wire 110 is allowed to return to its standby position. FIG. 5*b* illustrates the time-dependent displacement relationship of the wire in the conventional print head construction. It is known that the wire undergoes a time delay before it enters its return stroke after having hit the print paper, resulting in an increased period of time necessary for the wire to move back and forth. This phenomenon is explained schmatically in FIG. 5*a* which shows the leaf spring positioned immediately after the wire 110 has hit a sheet of print paper 50. When the wire 110 hits the sheet of print paper 50, the leaf spring 107 is deformed as shown under the moment M imposed by the impact of the armature about the center of impact and also due to the inertia of the leaf spring. This causes the leaf spring to undergo a series of secondary vibrations which lead to the phenomenon illustrated in FIG. 5*b*. This in turn increases the interval of time necessary for the wire to move back and forth, thus rendering print head operations unstable when the print head is driven at high speeds.

To improve the operation of the conventional print head, one known arangement uses two springs disposed in a criss-cross realtionship as shown in U.S. Pat. No. 4,136,978. The disclosed construction is disadvantageous, however, in that the parts used are complex in shape and structure, and are difficult to machine and assemble.

There are limitations on an attempt to reduce the inertial mass of the movable part in the conventional arrangement as will now be described by using specific representative numerical values with reference to FIG. 4.

If, for example, an attractive force of 1 Kg is to be gained, then the core is required to have a diameter of E=3 mm, and the coil wound therearound should have an outer diameter D equal to about 8 mm, taking into account the number of turns and electric resistance of the coil. When a 12-wire print is constructed with these dimensions, the distance R, between the center of the coil and the center of the head, is derived from the following geometric relationship shown in FIG. 4*b*:

$$\frac{D}{2R} \geqq \sin\left(\frac{360^\circ}{2 \times 12}\right)$$

and is expressed as R≧15.6 mm. Therefore, the distance R should be on the order of 16 mm. If the length L of the leaf spring is 5 mm, taking stresses and the spring constant into consideration, then the center P of rotation of the armature can be regarded as being substantially in the center of the leaf spring. Therefore, the ratio r of a wire stroke to a plunger displacement is given by the equation:

$$r = \frac{L/2 + (E/2) + B}{(L/2) + (E/2)}$$

Taking into account the dynamics considerations of the required attractive force, printing energy, and the required wire stroke, the ratio r is preferably on the order of 3, and by substituting the foregoing numerical values it is found that B=8 mm. When the printing end of the wire is positioned on the central axis of the head, the amount C of wire displacement is C=R−B=8 mm. If the wire is straight and hits the sheet of print paper at an angle $\phi=3°$, for example, the wire length l becomes 153 mm. For highly responsive operation, it is essential to reduce the inertial mass of the movable part. With the conventional print head construction, as described above, the fixed driven end of the wire cannot be positioned closely to the central axis of the head due to the limiting position of the coil. Hence, the wire is of an increased length and the inertial mass is increased, resulting in a limitation on the high-speed operation of the print head. In an effort to position the coil more closely to the central axis of the head, and reduce the distance R, various proposals have been made, including the use of cores of a triangular shape, sectorial cross sections and an increased lever length B. However, these attempts have had drawbacks in that the parts could not be machined and assembled easily and the attractive forces required were greater.

Another possible solution to the vibration problem would be to select a curve of suitable flexure of the wire to increase the angle at which the driven end of the wire is attached, thereby shortening the wire. The angle, however, would have to be selected in the range in which the wire could be driven without undue dynamic burdens, a limitation on the efforts to achieve a more lightweight wire.

The present invention has been made to eliminate the foregoing difficulties.

Figure 6A:
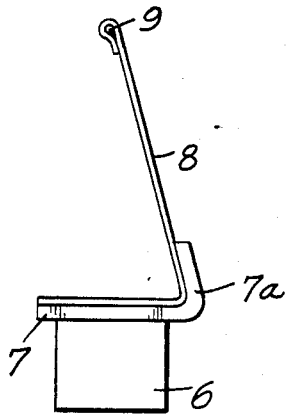
FIGS. 6*a* and *b* are views showing a lever and a leaf spring connected thereto in the wire dot print head according to the present invention.
Figure 6B:
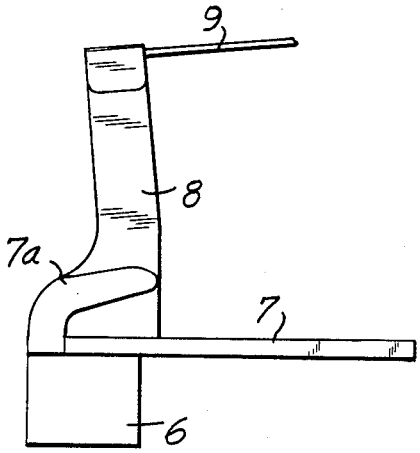

The present invention will now be described with reference to an embodiment thereof as shown in FIGS. 1 and 2. A core 2 is fixed to a lower yoke 3, and a permanent magnet 1 is sandwiched between the lower yoke 3 and the upper yoke 4. The permanent magnet 1 is secured in position by an attachment shaft 12. A leaf spring 7 and a lever 8 are fixed together by a plunger 6. Since these components are not subjected to the high temperatures which would be experienced by welding the parts together, as in the conventional arrangements, the spring resiliency of the spring 7 and the magnetic properties of the magnet 1 are not degraded. In addition these parts are not required to be complex in shape for the purposes for being welded together, and can therefor be small in size and lightweight. As shown in FIGS. 6*a* and *b*, the leaf spring 7 has a bent projection 7*a* joined to the lever 8 by resistance welding. This renders the joint between the lever 8 and the plunger 6 highly rigid, so that the direction of movement of the leaf spring is effectively converted by the lever without delaying the starting of the movement of the printing wire. This enables the print head to be responsive at high speeds and frees the printing wire from excessive bending loads. The result is that the printing wire is prevented from being vibrated and broken. When the lever 8 and the leaf spring 7 are to fixed in a position by the plunger 6, the lever 8 and the leaf spring 7 as joined can be mutually positioned. The lever 8 is welded to the leaf spring 7 and is thus prevented from being laterally vibrated during operation.

Figure 7A:
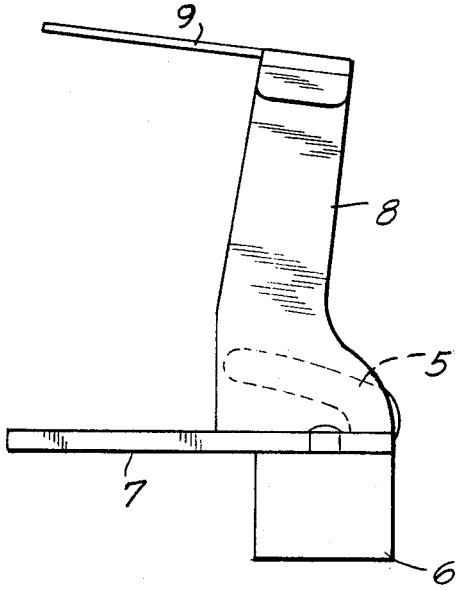
FIGS. 7*a* and *b* are views showing of a lever and a wire connected thereto in the wire dot print head of the present invention.
Figure 7B:
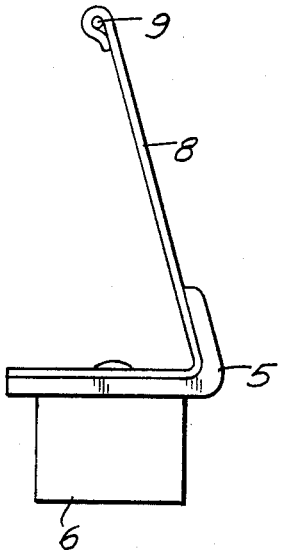

As illustrated in FIG. 7, the lever 8 is made of a thin sheet and has a distal end which is curved, and which wraps around the wire 9. The lever 8 and the wire 9 are secured together by resistance welding. These parts are simple in construction and easily machined. Even if the wire 9 and the lever 8 contact each other because of increased length, their inertial mass is small enough, and their inertial movement is small enough, that they can be joined with a high bonding strength. Since resistance welding produces localized heat for only a short period of time, the junction between the wire 9 and the lever 8 is not subjected to a large thermal load. In addition, the mechanical strength of wire 9 is retained, and the wire 9 and the lever 8 can be joined together in a shorter period of time than they could be if they were joined by brazing. The wire 9 and the lever 8 can be mutually positioned easily for improved assembly as they are not in an abutting engagement.

The leaf spring 7 is fixed between the upper yoke 4 and the presser plate 10 and is fastened by the attachment shaft 12. The presser plate 10 has a portion 10*c* which serves as an abutment for lever 8 when lever 8 is a standby condidtion. A stopper 11, made of rubber, is attached to the presser plate 10 by U-shaped member 11*a* to serve as an abutment for lever 8 when lever 8 is in an active position. The coil 5 is wound on the core 2 and has two springy electrical terminals, 15 and 16.

Each wire drive unit 30 of the foregoing construction is separately assembled and then removably mounted on head frame 13. For assembly, a plurality of wire guides 18–23 are placed beforehand into the head frame 13, and the wire drive unit 30 is mounted in the head frame 13 so that the projection of the presser plate 10 is fitted into the guide hole 13*a* defined in the head frame 13.

Figure 8:
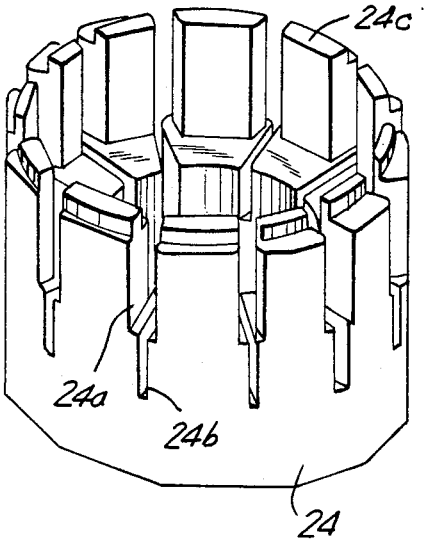
FIG. 8 is a perspective view of a lever guide in the wire dot print head of the present invention.
Figure 9:
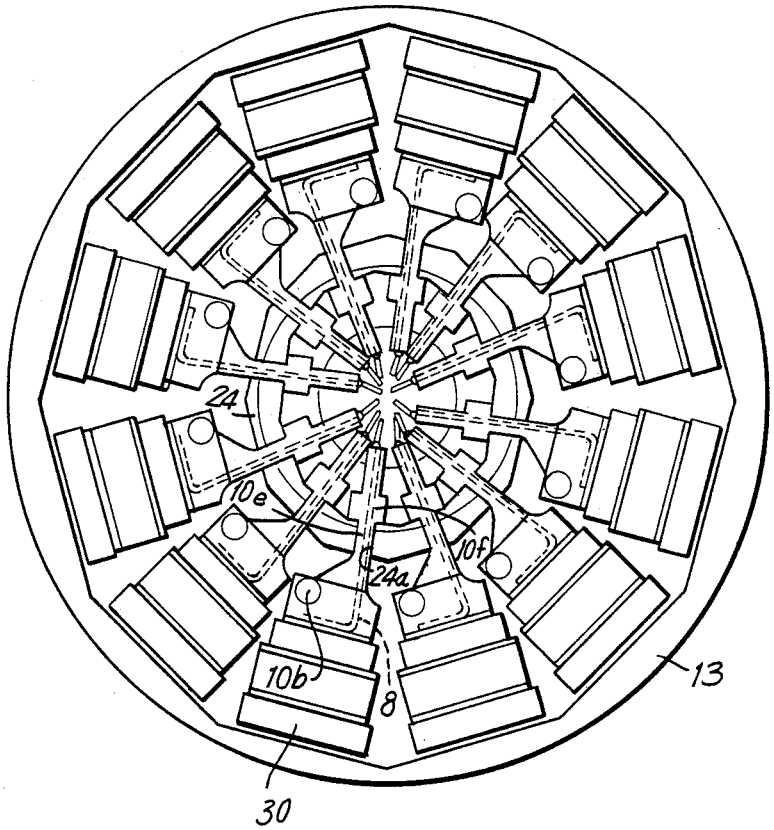
FIG. 9 is a view showing the wire dot print head of FIG. 1, with the rear cover omitted from the illustration.

FIG. 8 is a perspective view of the lever guide 24, and FIG. 9 is an illustrative view of the head body with the rear cover 25 removed therefrom. The lever guide 24 has wide slits 24*a* and narrower slits 24*b* and an end face 24*c* with a step for engagement with a rear cover 25. Each of the drive units 30 is assembled into the head body by first setting the wire guides 18–23 and the lever guide 24 into the head frame 13, and then inserting portions 10*e* of the presser plates into the slits 24*a* of the lever guide 24, and projection 10*a* into the guide hole 13*a* of the head frame 13. As shown in FIG. 9, projections 10*f* of the presser plates engage the inner peripheral surface of the lever guide for postioning the drive unit 30 radially. The levers 8 are guided at their side surface by the slits 24*b* in the lever guide so that the levers 8 can be prevented from being tranversely vibrated. The electrical terminals 15 and 16 are pressed into electrical contact with a corresponding pattern on a circuit board 17. A rubber sheet 14 is interposed between the head frame 13 and the drive units to eliminate difficulties in assembly due to variations in the lengths of the drive units and to prevent noise from being produced. The rear cover 25 is resiliently secured to the head frame 13 by an attachment spring 26. The printer head is thus assembled.

Operation of the printer head will now be described. The plunger 6 is attracted to the core 2 under a magnetic flux which is generated by the permanent magnet 1 in order to keep the leaf spring 7 is a biased position. When a current is passed through the coil 5 a magnetic force is produced which cancels out the magnetic field from permanent magnet 1. The plunger 6 is then released from core 2 and the lever 8 is turned to cause the wire 9 to project. The wire 9 is thus forced into an ink ribbon which then leaves a mark on the print paper (not shown). After a dot has been formed by the wire 9 on the print paper, the plunger 6 is attracted to the core 2 again and the wire 9 returns to its standby position. Simultaneously, the lever 8 hits the stopper 11 at the same time the plunger 6 hits the core 2. In this way wire 9 is prevented from moving past its standby position and is stopped quickly in its standby position with a very small rebound. This moving system, including the wire, is accordingly operated in a very stable and highly responsive manner without any disturbances, particularly when being driven at high speeds.

As shown in FIG. 1, the presser plate 10 and the stopper 11 have slanted engaging surfaces. The stopper 11 is slidable up and down in member 11*a* so that its surface, which engages the lever 8, can be adjusted back and forth in lateral directions as shown in FIG. 1. Thus, even when the standby position of the lever 8 varies, for example, due to the machining inaccuracies of the parts, the lever 8 can be set into an optimum position by sliding the stopper 11 up and down.

In the present embodiment, the stopper 11 is made of polyurethane and has a sufficient degree of rigidity, impact-resistance, and wear-resistance to limit the stroke of the lever in the standby position thereof.

With construction according to this embodiment, any impact at the time plunger 6 and core 2 hit is reduced so that these parts are subjected to less wear and deformation.

The result of this construction is that lever 8 undergoes no residual vibrations and the movement of wire 9 is not disturbed during high speed operation. In addition the bending load of the wire is lowered and the service life of the wire is increased.

Figure 3A:
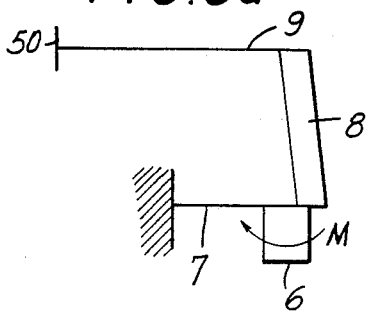
FIG. 3*a* is a schematic diagram of a leaf spring in the wire dot print head of the present invention.
Figure 3B:
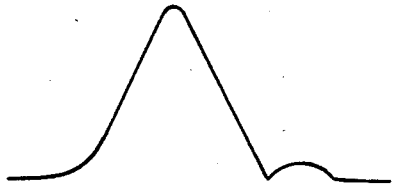
FIG. 3*b* is a diagram showing the time-dependent displacement relationship of the wire in the present invention.

As illustrated in FIG. 3*b*, the time-dependent displacement relationship of the wire according to the illustrated embodiment is such that after the wire hits the print paper the wire quickly enters its return stoke and is brought to a stop. This occurs because the leaf spring is arranged parallel to the axis of the print head and thus has a higher rigidity against impact. FIG. 3*a* schematically shows the leaf spring positioned immediately after the wire has engaged the print paper 50. As shown, a moment in the direction M is imposed on the lever 8 about the center of impact and is directed lengthwise along the leaf spring, which is protected from being deformed by forces applied in that direction. This also frees the leaf spring from secondary vibrations. Thus the time interval required for the wire to move back and forth is shortened and the wire can operate stably when driven at high speeds for highly responsive operation.

Figure 10:
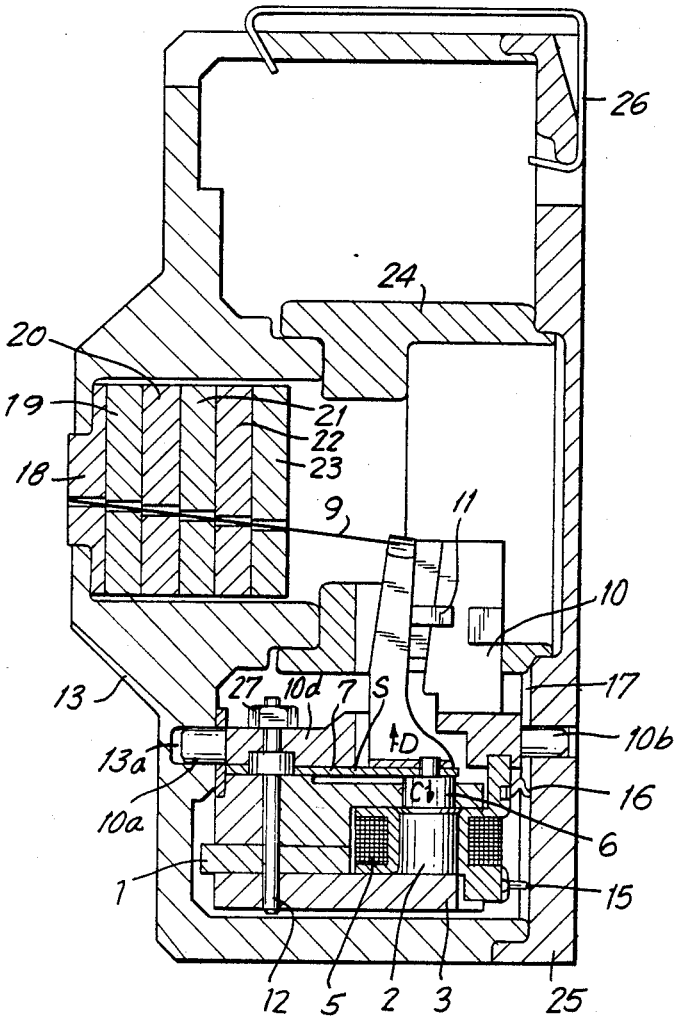
FIG. 10 is a cross-sectional view illustrating a leaf spring attachment in the wire dot print head of the present invention.

As shown in FIG. 10, the presser plate 10 has a leaf spring attachment 10*d* which extends closely to the center S of the effective spring length of the leaf spring 7. While the leaf spring 7 is freely movable in the direction of the arrow C throughout the entire spring length, the portion of the leaf spring 7 which extends from the center S to the attached end thereof is limited by the leaf spring attachment 10*d* in movement in the direction D, with the leaf spring attachment 10*d* extending closely to the center S of the spring length of the leaf spring 7. The leaf spring is thus prevented from secondary vibrations. This allows the wire to return rapidly to the standby position after a printing operation has been carried out.

The reduction of weight of the movable parts will now be described. The dimensions of components will be explained on the basis of specific numerical values as with the example given above.

Assuming a core diameter of E=3 mm and an outside coil diameter of D=8 mm, for a 12-wire printer head, the distance R from the center of the printer head to the coil end surface can be derived from:

$$\frac{D}{2R} \geqq \sin\left(\frac{360°}{2 \times 12}\right)$$

and is given by R=16. Let the distance F from the coil end surface to the spring be 2 mm and the ratio r of the wire stroke to the plunger displacement be 3, and the center P of rotation of the lever can be regarded as being positioned substantially centrally of the effective spring length of the leaf spring. The length G of the lever can then be found from the following equation (L=5, the same as the aformentioned example):

$$r = \frac{G}{L/2 + E/2} = 3$$

and is 12 mm. Therefore, the amount C of displacement of the wire is $C=R-(F+G)=2$ mm. Where the wire is a straight one and the angle at which the wire hits the print paper is $\phi=3°$, the necessary wire length $l=38.2$ mm. Accordingly, the mass of the wire which is a major portion of the inertial mass of the movable part is reduced to ¼ of that of the conventional construction. Thus, the movable part of the print head of the invention is much lighter in weight for high speed printing operation.

Figure 11:
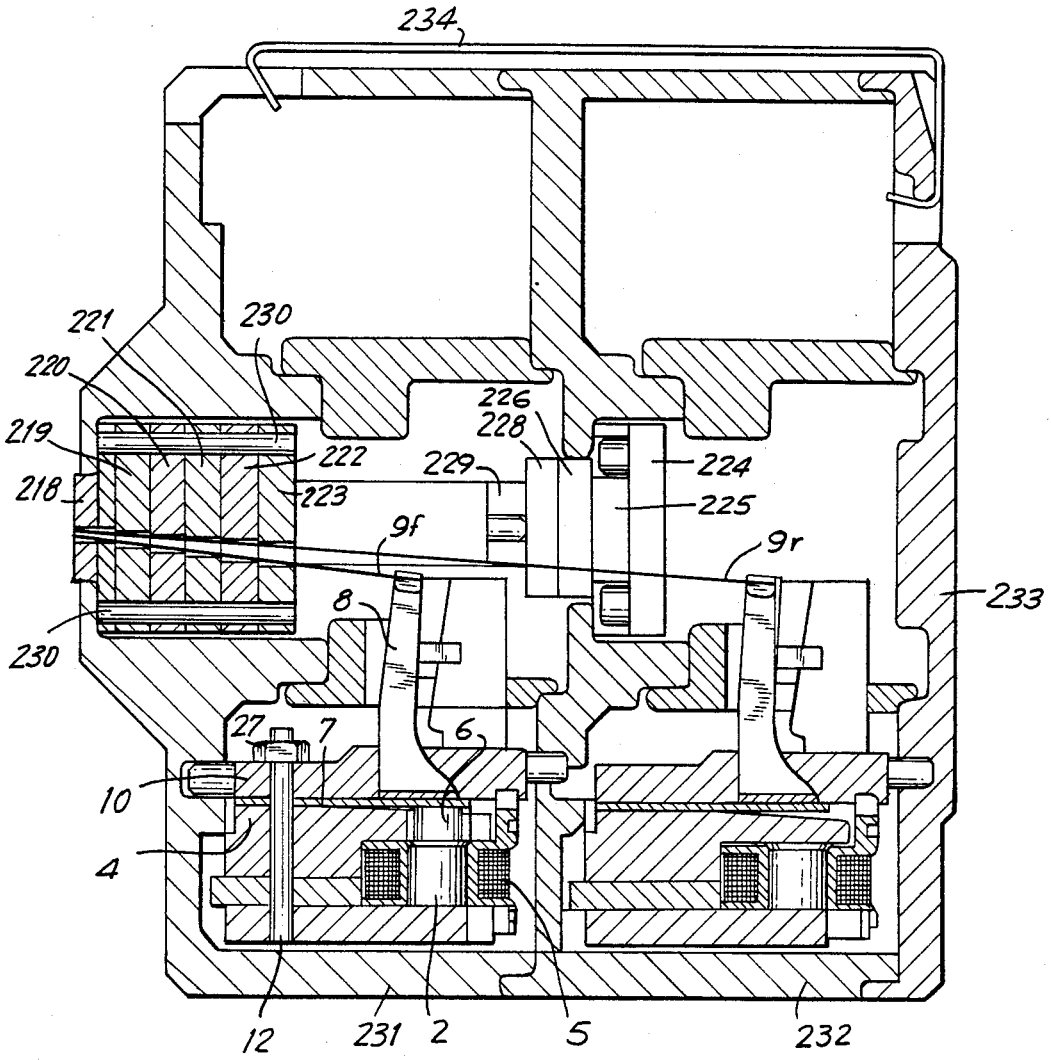
FIG. 11 is a cross-sectional view of a double-deck wire dot print head according to another embodiment of the present invention.
Figure 12:
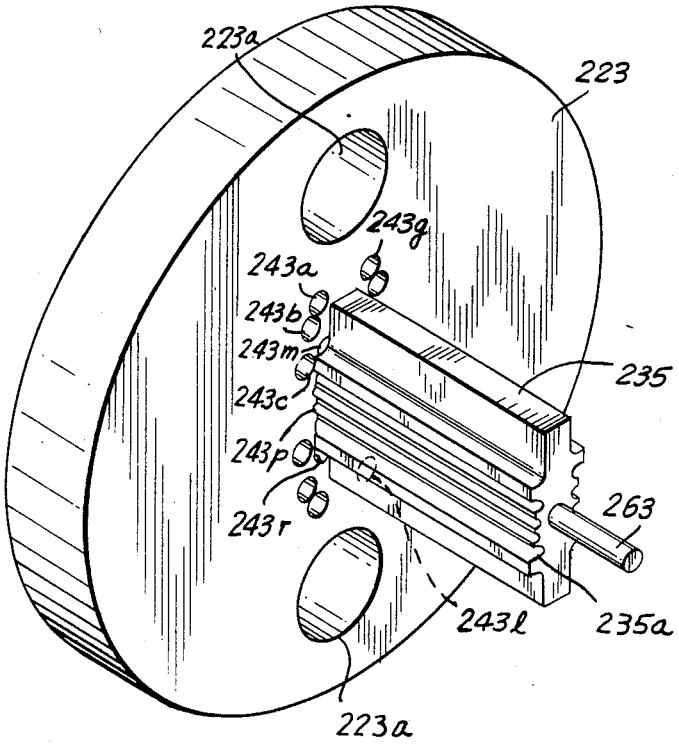
FIG. 12 is a perspective view of a wire guide plate in the wire dot print head of the present invention.

Turning to FIGS. 11 and 12, a double-deck 24-pin wire dot print head employing the foregoing drive units 30 with 12 pins in each of the front and the rear head portions will now be described.

FIG. 12 is a perspective view of a wire guide plate 223 having a plate-like projection 235 which divides the guide holes 243*a–f* from 243*g–l* and 243*m–r* from 243*s–x*, and has U-shaped grooves 235*a* defined on both lateral sides thereof. The U-shaped grooves 235*a* communicate with the guide holes 243*m* through 243*x* (the guide holes 243*s* through *x* are not seen as they are positioned rightward of the projection 235) for printing wires in the rear head portion. Guide holes for printing wires in the front head portion are defined in surrounding relation to the guide holes for the rear printing wires. Wire guide attachment shafts 230 ae inserted through holes 223*a*.

The plate-like projection 235 has on its end a projection 263 for engagement with a rear wire guide 229. The wire guide plate 223 and the wire guides 219, 220, 221 and 222 in the front head portion are positioned and secured together by the wire guide attachment shaft 230. The wire guide 223 in the front head portion and the wire guide 229 in the rear head portion are relatively positioned by the projection 263 held in engagement with the wire guide 229.

For assembling the print head, the front drive units are first attached to a front head frame 231 by inserting printing wires 9*f* into the front guide holes 243*a* through 243*l* defined in the wire guide 223 to allow the printing wires 9*f* to be guided through the wire guide 222, 221, 220, 219 and 218. Then, a rear head frame 232 is attached to the front head frame 231. When assembling drive units into the rear head frame 232, printing wires 9*r* are first inserted into the guide holes in a rear wire guide 224 and then through wire guides 225, 226, 228 and 229. When the printing wires 9*r* reach the plate-like projection 235 of the wire guide 223, they are guided by the U-shaped grooves 235*a* defined in the projection 235 into the guide holes 243*m* through 243*x* in the wire guide 223 and into the guide holes of the wire guide 223, 222, 221, 220, 219 and 218 completing the assembly of the drive units. In this manner, twelve drive units are assembled in the rear head frame 232 and then a rear cover 233 is attached. Thereafter the head frames are securred together by an attachment to the leaf spring 234. This completes the assembly of the print head.

With the wire dot print head having front and rear head units, the spaced wire guides are relatively positioned and the plate-like projection 235, with the U-shaped grooves 235*a* for guiding the printing wires, is mounted on the wire guide which is located at the driven ends of the wires. When the printing wires are inserted they are guided by the U-shaped grooves into their proper wire guide holes. This allows the printing wires to be inserted easily in a short period of time and enables the print head to be assembled with the utmost ease. While in the foregoing embodiment the spaced wire guides 223 and 228 are relatively positioned through mutual engagement, only the plate-like projection with the U-shaped grooves is highly effective in allowing the wires to be inserted easily in position.

In the present invention the movable parts are reduced in weight and the leaf spring is rendered stable and capable of high speed operation through a simple construction technique resulting in a highly responsive print head. The lever can be prepared simply by bending a thin plate. This yields a lever that has the required degree of rigidity, is lightweight and can easily be attached to the leaf spring. Consequently, components can be machined and assembled with much more ease than conventional arrangements.

In addition, drive units which contain the permanent magnets are magnetically independent of each other with no mutual magnetic interference. The overall print head can thus be small in size and lightweight. The numerical values referred to above in describing the conventional construction and the embodiment of the present invention are illustrative only, and should not be interpreted as being limitative in determining the scope of the invention.

It will thus be seen that the objects set forth above, and those made apparent from the preceding description, are efficiently attained, and since certain changes may be made in the above construction without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention, as a matter of language, might be said to fall therebetween.

What is claimed is:

1. A wire dot print head having a central axis comprising:

a leaf spring;

a plunger fixed to said leaf spring;

a permanent magnet for attracting said plunger in a direction to bias said leaf spring;

a demagnetizing coil for selectively cancelling out magnetic flux from said permanent magnet when a current is passed through the coil to allow the release of said plunger from said permanent magnet to permit release of said bias on said leaf spring;

a lever affixed to said leaf spring and holding a printing wire, said leaf spring extending essentially parallel to the central axis of the print head, whereby said printing wire is displaced for printing upon the release of said bias; and an attachment member to which said leaf spring is affixed at a position spaced from said lever, said attachment member including a portion extending along the surface of said spring facing in the direction of release of said bias of said leaf spring to a position close to the center of the effective spring portion of said leaf spring.

2. A wire dot print head according to claim 1 wherein said leaf spring, plunger, permanent magnet, demagnetizing coil and lever define a wire drive unit said wire dot print head including a plurality of wire drive units arranged substantially in a circular pattern.

3. A wire dot print head according to claim 1, wherein said wire and said leaf spring extend substantially parallel to each other, said lever being in the form of a plate, and said lever interconnecting said wire and said leaf spring, and said leaf spring having a bent projection on a free end thereof, said bent projection being secured to said lever.

4. A wire dot print head according to claim 1, wherein said wire and said leaf spring extend substantially parallel to each other, said lever being in the form of an L-shaped plate, and interconnecting said wire and said leaf spring, said leaf spring and said lever being staked together by said plunger.

5. A wire dot print head according to claim 1, wherein said lever is connected to said wire through a bent portion winding around said wire therein.

6. A wire dot print head according to claim 4, wherein said lever and said wire are secured together by resistance welding.

7. A wire dot print head according to claim 1 including a stopping means for abutment by said leverage adjacent to a portion to said lever connected to wire when said leaf spring is biased, wherein said stopping means is wedged-shaped and adjustable longitudinally to selectively set the rest position of said lever.

8. A wire dot print head according to claim 1, wherein said leaf spring, plunger, permanent magnet, demagnetizing coil and lever define a wire drive unit, including a plurality of wire drive units including a head body to which said wire drive units are individually detachably attached, and further including a resilient body interposed between said drive units and said head body.

9. A wire dot print head according to claim 1, wherein said wire and said leaf spring extend substantially parallel to each other, said lever being in the form of a plate, and interconnecting said wire and said leaf spring, including a head body having guide slits for guiding a side of said lever.

10. A wire dot print head according to claim 1, wherein said leaf spring, plunger, permanent magent, demagnetizing coil and lever define a wire drive unit, and including a plurality of wire drive units arranged in at least two tiers.

11. A wire dot print head according to claim 10 including a means for guiding said wires, said means having a plate-like projection having U-shaped grooves defined in its surface thereof each for guiding at least one of said wires, said means having wire guide holes corresponding to said U-shaped grooves.

12. A wire dot print head as recited in claim 10, said wire drive unit arranged in at least two overlapping tiers and in an essentially circular pattern within each tier.

* * * * *